United States Patent [19]

Kuragasaki et al.

[11] Patent Number: 5,022,787

[45] Date of Patent: Jun. 11, 1991

[54] METHOD OF RETURNING GEOTHERMAL GASES TO THE UNDERGROUND

[75] Inventors: Mutsuo Kuragasaki; Mamoru Tahara; Shunsei Tazaki, all of Nagasaki, Japan

[73] Assignee: Mitsubishi Jukogyo Kabushiki Kaisha, Tokyo, Japan

[21] Appl. No.: 418,115

[22] Filed: Oct. 6, 1989

[30] Foreign Application Priority Data

Jul. 10, 1988 [JP] Japan ..... 63-253056

[51] Int. Cl.[5] ..... G21F 9/24

[52] U.S. Cl. ..... 405/128; 405/53; 405/59; 166/305.1

[58] Field of Search ..... 405/128, 129, 258, 303, 405/59, 58; 166/305.1, 309

[56] References Cited

U.S. PATENT DOCUMENTS

| | | | |
|---|---|---|---|
| 3,889,764 | 6/1975 | Jackson | 166/309 |
| 4,457,375 | 7/1984 | Cummins | 166/309 |
| 4,632,601 | 12/1986 | Kuwada | 405/128 |

*Primary Examiner*—Dennis L. Taylor

*Attorney, Agent, or Firm*—Toren, McGeady & Associates

[57] ABSTRACT

Disclosed is a method of returning geothermal gases discharged from geothermal plants to the underground together with waste water through a return well, characterized in that the apparent velocity of waste water $V_{eo}$ relative to the return well is equal to or more than 1 m/s and the range of the apparent velocity of waste water $V_{eo}$ and of an apparent velocity of the geothermal gases $V_{go}$ is regulated to satisfy the following equation:

$$V_{go} < 1.33 V_{eo} - 0.41.$$

2 Claims, 4 Drawing Sheets

(x) BUBBLES
(y) WATER (WATER FLOW)
(z) WATER DROPLETS

METHOD OF RETURNING GEOTHERMAL GASES TO THE UNDERGROUND

FIELD OF THE INVENTION AND RELATED ART STATEMENT

The present invention relates to a method for returning geothermal gases discharged from geothermal plants t the underground.

At present, large amounts of noncondensing gases and toxic gases such as $H_2S$ and $SO_2$ that are contained in geothermal steam are extracted at condensers or the like and simply released into the atmosphere or released after being desulfurized at very high costs.

OBJECT AND SUMMARY OF THE INVENTION

The method of the present invention is an alternative to the conventional release of these noncondensing or toxic gases into the atmosphere, treated or untreated. According to the present invention, the noncondensing or toxic gases present in geothermal steam for geothermal turbines are returned to the underground by way of an underground return well for waste water together with the waste water. When returning to the underground in this way, however, the flow inside the return well becomes a two-phase vertical downward flow of the gas and liquid phases. Therefore, when the apparent gas velocity $V_{go}$, in relation to the apparent velocity of the waste fluid $V_{eo}$, becomes greater than a certain value for the ratio $\alpha cr = V_{go}/V_{eo}$, the waste water does not carry (accompany) all the gas phase, and it becomes impossible to return the gas to the underground.

Taking advantage of the flow characteristics of a two-phase vertical downward flow of the gas and the liquid phases in a tube, the present invention resolves the above problem by controlling the range of apparent velocities, $V_{eo}$ and $V_{go}$, of the waste water and the gas with respect to the return well so that the size (diameter) of the return well can be selected to suit the amount of waste water $Q_e$ and the amount of waste gas $Q_g$.

The present invention is characterized in that, when the geothermal gas is returned to the underground together with the waste water through an underground return well, the range of the apparent velocities, $V_{eo}$ and $V_{go}$, of the waste water and the gas, respectively, is set by an equation, $V_{go} < 1.33V_{eo} - 0.41$, so that the geothermal gas is accompanied downward by the waste water and the hydrostatic pressure in the depth direction becomes effective at the same time. This is achieved in the present invention by studying the flow characteristics of a two-phase tubular flow of the gas and the liquid phases in the vertical and downward direction.

According to the present invention, the geothermal gas which goes downward accompanied by the waste water in the return well is compressed by the water pressure and is also dissolved into the waste water so that the volume of the geothermal gas is reduced with respect to that of the waste water, and at the bottom of the well, the geothermal gas becomes completely dissolved or is turned into fine bubbles so as to flow into the earth crust together with the waste water.

DETAILED DESCRIPTION OF PREFERRED EMBODIMENTS

Figure 1:
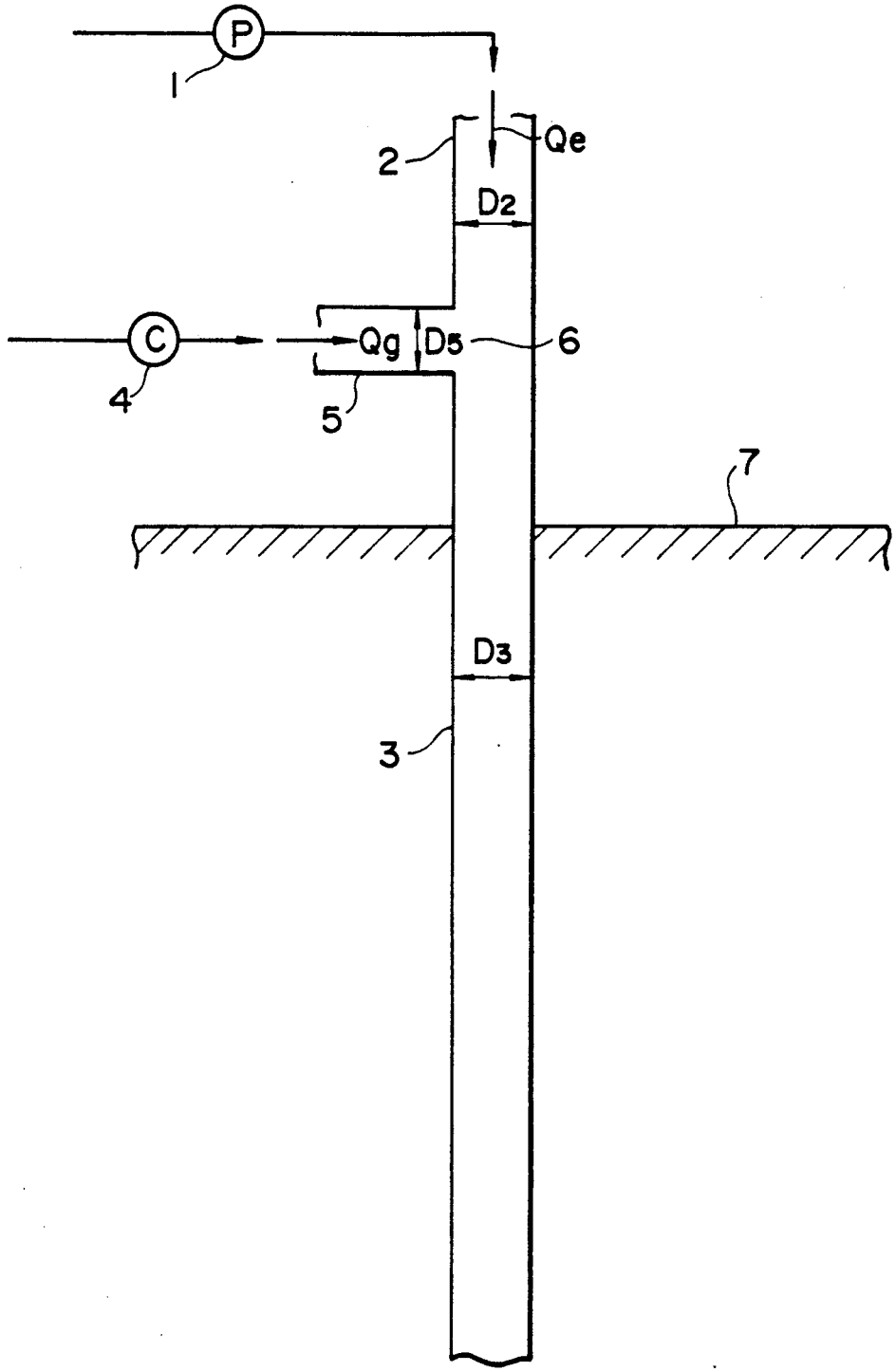
FIG. 1 shows a schematic diagram for describing an embodiment of the present invention.

FIG. 1 shows an embodiment of the present invention. Waste water $Q_e$ flows into a return well 3 by way of a water pipe 2 above the return well by the action of a pump 1. A geothermal gas $Q_g$ is forced into a gas pipe 5 by a compressor 4 and into the waste water in the return well 3 through a top opening 6. 7 indicates the ground level.

For the geothermal g ɜ sent into the waste gas to be accompanied (carried) by the waste water all the way down to the bottom of the return well, the apparent velocity of the waste water $V_{eo}$ ($=Q_e/A$, where $A=\pi D_3^2/4$) relative to the well 3 is set to a value equal to or more than 1.0m/s. Furthermore, in order to put the gas flowing downward under a hydrostatic pressure of the waste water, the apparent velocity of the gas $V_{go}(=Q_g/A$, where $A=\pi D_3^2/4)$ is controlled in the range satisfying an equation: $V_{go} < 1.33V_{eo} - 0.41$.

In the above equation $Q_e$ is the volume flow rate of the waste water, $G_g$ the volume flow rate of the gas, $V_{eo}$ the apparent flow velocity of the waste water in the return well, $V_{go}$ the apparent flow velocity of the gas in the well, and $D_3$ the diameter of the return well.

Figure 2:
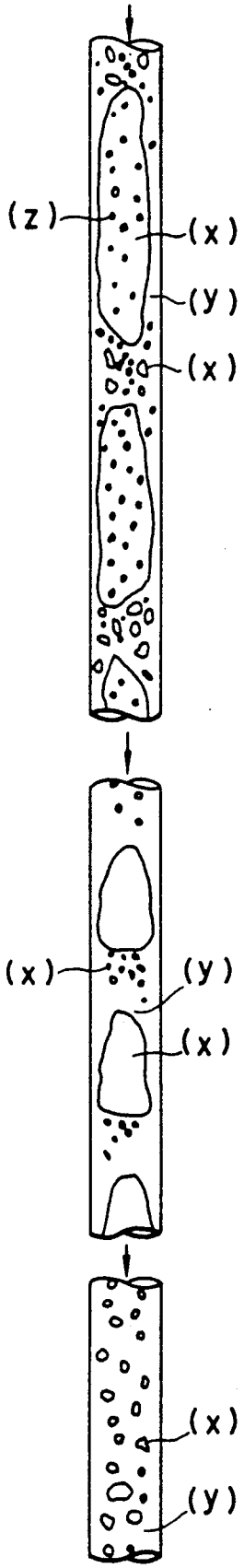
FIG. 2 shows flow patterns of the waste water and the geothermal gas in the return well.

Thus, as shown in FIG. 2, the manner of flow below the mixing point of gas and liquid in the return well turns from a froth flow to a slug flow and then to a bubble flow as going down in the well. The volume of the gas becomes reduced while the gas is carried to the bottom of the return well, accompanied by the waste water. In FIG. 2, as indicated the regions designated (x) represent bubbles, the regions designated (y) represent water (water flow), and the regions designated (z) represent water droplets. In the upper pipe section, froth flow is represented in the middle pipe section, slug flow is represented; in the lower pipe section, bubble flow is represented.

Figure 3:
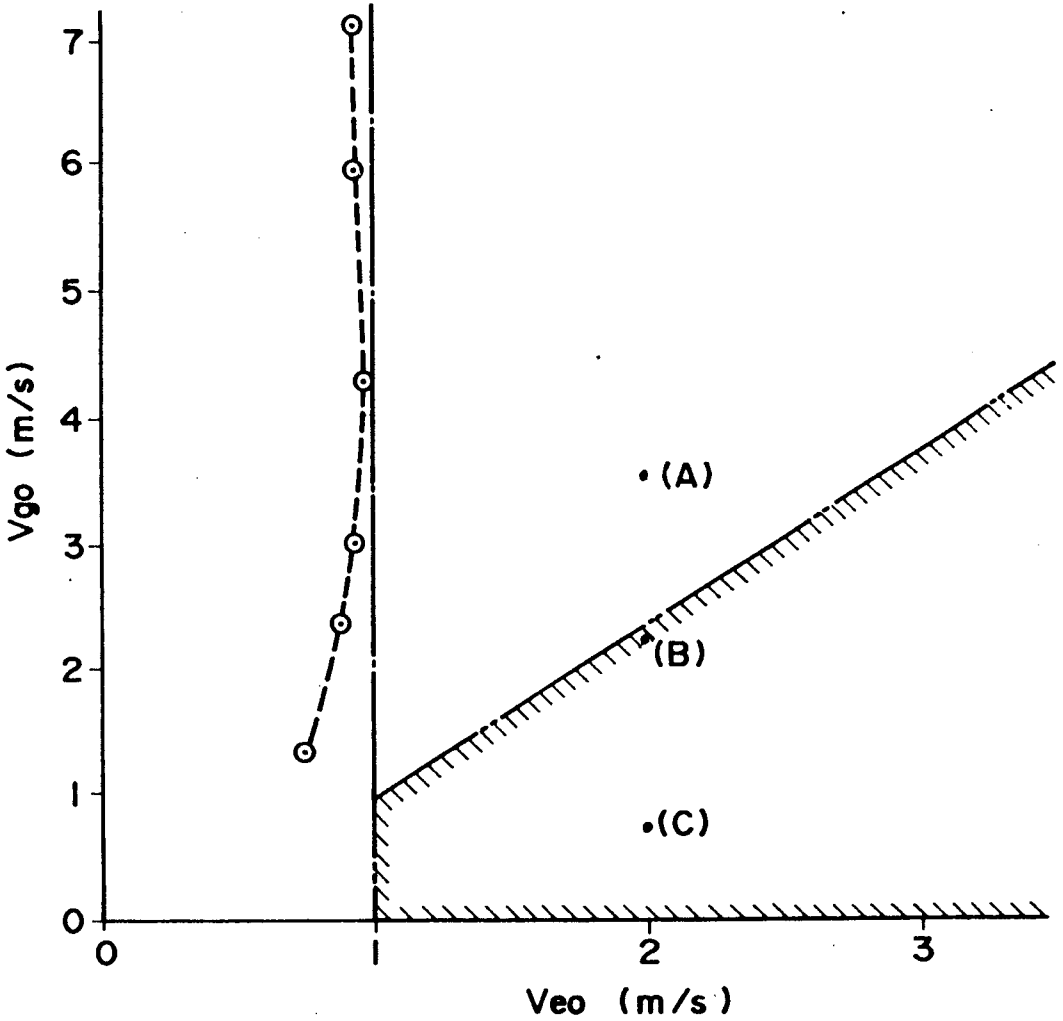
FIG. 3 is a graph showing the relation between the velocity of the waste water and that of the gas according to an embodiment of the present invention.
Figure 4:
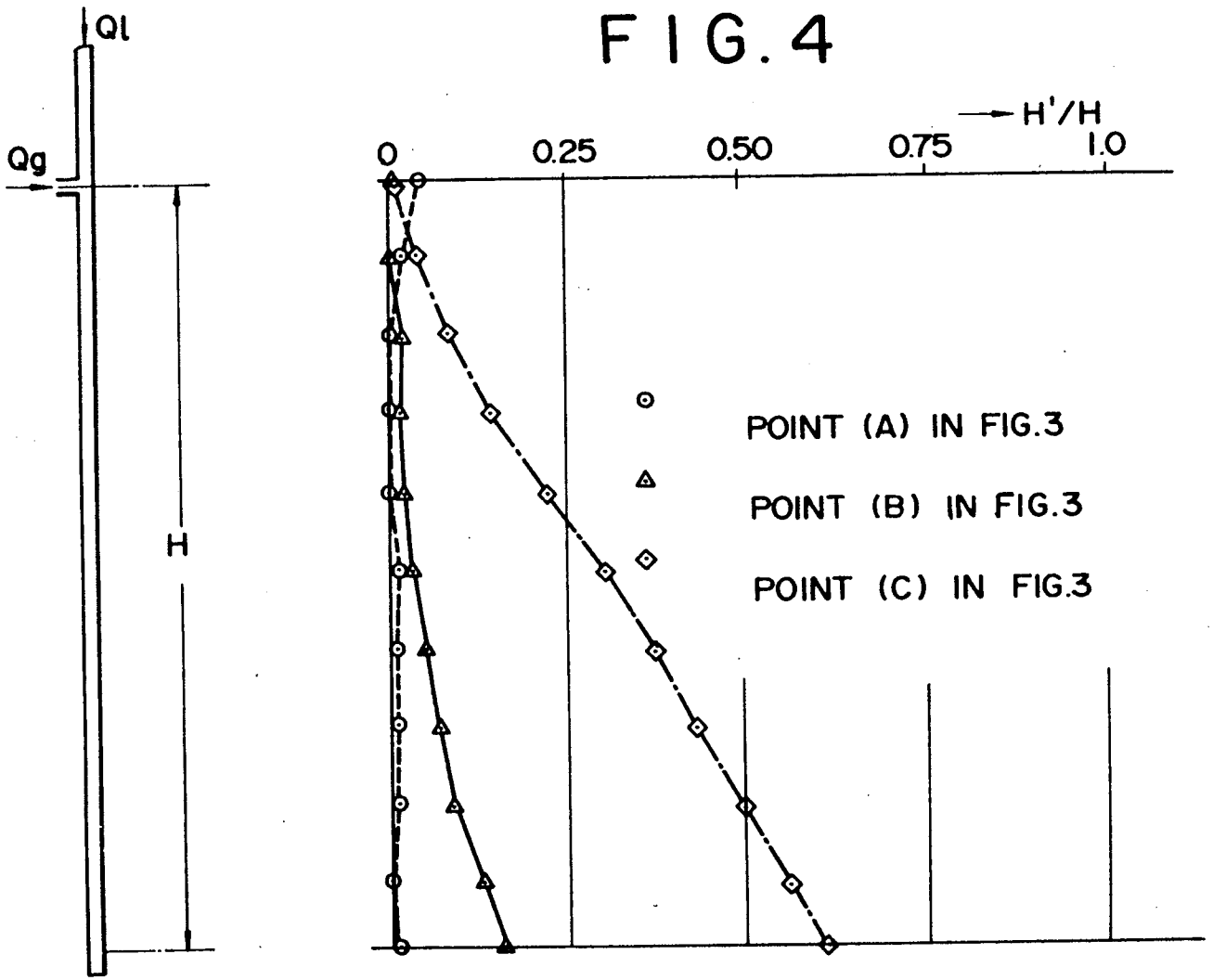
FIG. 4 shows the pressure distribution according to the present invention.

FIG. 3 shows the waste water velocity condition, $V_{eo} < 1.0$m/s, as a limit for accompanying (carrying) the geothermal gas and for the downward flow of the gas. In FIG. 3, the vertical dash-dot line separates the perfectly accompanying region as in the present invention on the right-hand side, from the imperfectly accompanying region on the left-hand side. The dashed curve with the circled points is the experimental confirmation. The straight line curve (near point B) represented by the dashed-double-dotted line defines below it the region of flow parameters in the return well as set in the present invention, namely, where $V_{go} < 1.33V_{eo} - 0.41$. FIG. 3 also shows the experimental relationship between the waste water velocity $V_{eo}$ and the gas velocity $V_{go}$ for making the hydrostatic pressure effective in the return well. Also, FIG. 4 shows an example of the pressure distribution in the return well. In FIG. 4, H is the corresponding head of water between points (1) and (2) of the return well; H′ is the experimentally observed head of water; the circled points on the dashed curve were taken under flow conditions corresponding to point (A) in FIG. 3 (annular flow); the triangular points on the solid line curve were taken under flow conditions corresponding to point (B) in FIG. 3 (froth flow); the diamond points on the dash-dot curve were taken under flow conditions corresponding to point (C) in FIG. 3 (bubble flow). In this figure, in the flow pattern region (A) where the waste water velocity $V_{eo}$ is large compared to the gas velocity $V_{go}$ and a large annular spray flow or an annular flow is observed, the pressure in the return well is almost constant and the hydrostatic pressure does not play any role. Thus, changes in the gas volume in the return well are small, and most of the gas is carried to the bottom of the well as it is, remaining in the gaseous state. This makes it more difficult to return the gas to the earth crust.

When the gas velocity becomes relatively small and the manner of the flow below the mixing point becomes a froth flow, however, the hydrostatic pressure becomes effective in the depth direction and sloped as shown by the pressure distribution (B). As the gas flows down deep in the well, the gas volume is reduced, and the change of the flow pattern is supported by these data. The third curve for flow conditions at point (C) demonstrates the increase in hydrostatic pressure as the gas velocity is further reduced.

The divisional line in the $V_{go}$-$V_{eo}$ plane in FIG. 3 is obtained by plotting the experimental bordering points at which the pressure distribution becomes sloped immediately after the mixing point of gas and liquid and at which the hydrostatic pressure begins to be effective.

What is claimed is:

1. A method of returning geothermal noncondensable gas including $H_2S$ gas together with geothermal waste water into an underground statum through a waste water return well under the two-phase gas-and-liquid flow conditions of froth or slug flow at the gas returning point around the wellhead, characterized in that the introduction of the geothermal gas at the gas returning point around the wellhead is regulated to satisfy the following equation;

$$V_{go} < 1.33 V_{eo} - 0.41,$$

where $V_{go}$ and $V_{eo}$ are the apparent velocity of the geothermal gas and the waste water at said gas returning point, respectively, and $V_{eo}$ at said gas returning point is not less than one meter per second, and where apparent velocity is defined as the volumetric flow rate of the fluid divided by the well cross-sectional area at said gas returning point.

2. The method of claim 1, wherein the gas is introduced into the waste water above the ground level of the stratum.

* * * * *

UNITED STATES PATENT AND TRADEMARK OFFICE

CERTIFICATE OF CORRECTION

PATENT NO. : 5,022,787

DATED : June 11, 1991

INVENTOR(S) : Mutsuo Kuragasaki etal

It is certified that error appears in the above-identified patent and that said Letters Patent is hereby corrected as shown below:

On the title page, item [30] should be corrected to read as follows:

[30] Foreign Application Priority Data

October 7, 1988 [JP] Japan .....63-253056

Signed and Sealed this

Eighth Day of December, 1992

*Attest:*

DOUGLAS B. COMER

*Attesting Officer*

*Acting Commissioner of Patents and Trademarks*